US007188550B2

(12) United States Patent
Tsai

(10) Patent No.: US 7,188,550 B2
(45) Date of Patent: Mar. 13, 2007

(54) OPEN END ADJUSTABLE SPANNER

(76) Inventor: Chen-Chang Tsai, PO Box 82-144, Taipei (TW)

( * ) Notice: Subject to any disclaimer, the term of this patent is extended or adjusted under 35 U.S.C. 154(b) by 36 days.

(21) Appl. No.: 10/975,423

(22) Filed: Oct. 29, 2004

(65) Prior Publication Data

US 2006/0090607 A1 May 4, 2006

(51) Int. Cl.
*B25B 13/00* (2006.01)
*B25B 13/46* (2006.01)
*B25B 23/16* (2006.01)

(52) U.S. Cl. ..... 81/58.2; 81/58.3; 81/63.1; 81/177.8

(58) Field of Classification Search ..... 81/58.2, 81/58.3, 58.4, 60, 61, 63.1, 177.8, 180.1, 81/185.1, 58.1, 119, 177.5
See application file for complete search history.

(56) References Cited

U.S. PATENT DOCUMENTS 2,521,419 A * 9/1950 Sellers ..... 81/63.1
3,171,643 A * 3/1965 Roos ..... 267/64.15
5,454,283 A * 10/1995 Stefano ..... 81/58.2
5,501,124 A * 3/1996 Ashby ..... 81/58.2
5,775,184 A * 7/1998 Cole ..... 81/60
6,139,476 A * 10/2000 Gallant ..... 482/114
6,151,993 A * 11/2000 Shiao ..... 81/60
6,155,140 A * 12/2000 Tsai ..... 81/61
6,318,215 B1 * 11/2001 Armfield, IV ..... 81/58.2
6,330,840 B1 * 12/2001 McCormick et al. ..... 81/57.3
6,810,773 B2 * 11/2004 Trucchio ..... 81/58.2
6,948,405 B1 * 9/2005 Simmons ..... 81/63
2002/0162422 A1 * 11/2002 Kerzhner ..... 81/58.2

* cited by examiner

*Primary Examiner*—Lee D. Wilson
*Assistant Examiner*—Alvin J. Grant

(57) ABSTRACT

A new mechanism of an open-end adjustable spanner which includes a right latch, a left latch, a return spring, and a control member containing hairpin springs and a serrated bit installed in an accommodation trough of a handle to create a torque transmission structure to turn a ratchet by gearing to permit easy alignment of the ratchet with the bolt or nut and avoid slipping therefrom before and after tightening or loosening the bolt or nut; and allow effort-saving and convenient torque application in clamping head of a bolt or nut by selecting a proper specification of the configuration of the open end of the ratchet.

1 Claim, 3 Drawing Sheets

OPEN END ADJUSTABLE SPANNER

BACKGROUND OF THE INVENTION (a) Technical Field of the Invention

The present invention is related to a new construction of an open end adjustable spanner, and more particularly to one which allows easy alignment with the bolt or nut and avoids slipping therefrom before and after tightening or loosening up the bolt or nut.

(b) Description of the Prior Art

An open-end adjustable spanner is one of the common hand tools either at home or in a factory. According to the survey, the ordinary open-end spanner is the most popular hand tool. However, it is the least handy and economic tool since its working angle is limited within 15 degrees of travel. Another type of single acting adjustable spanner though operating on single latch and ratchet to execute a local transmission by the circumference of the serrated section of the ratchet, normal transmission of force is prevented at the gap of the circumference of the ratchet. Accordingly, the single acting adjustable spanner is unsatisfactory in use. Another type yet of an adjustable spanner has on both sides of the gap of the ratchet respectively adapted with a latch to constitute a leverage engagement so that the force applied to either or both of the latches execute the transmission of gearing progression to continuously transmit multiplied force. Consequently, the adjustable spanner with two latches is fast, handy and effort-saving in operation. However, the width of the opening of the adjustable spanner with two latches is usually fixed. Therefore, in clamping bolt or nut in various sizes, frequent exchange of spanner is required and becomes annoying. Furthermore, since the orientation of the opening is fixed, it makes the clamping awkward, that is, difficult to align at the work piece, particularly so true when operating within a very limited space.

SUMMARY OF THE INVENTION

The primary purpose of the present invention is to provide an innovative open-end adjustable spanner mechanism that allows easy alignment with the bolt or nut and avoids slipping therefrom before and after tightening or loosening the bolt or nut. To achieve the purpose, essentially by having two latches, a return spring, a control containing a pair of hairpin spring and a serrated bit respectively installed by deck into an accommodation trough at the head of the spanner for producing another type of transmission by gearing to turn the ratchet. Furthermore, selection of a configuration of the opening of the ratchet is permitted depending on the specific size of the bolt or nut to provide handy and efforts-saving application for torque in turning the spanner.

Another purpose of the present invention is to provide an innovative open-end adjustable spanner mechanism that promotes the handy and general use of the spanner by reducing the exchange frequent of the spanner in coping with work pieces of different sizes. To achieve the purpose, the opening section of the ratchet of the present invention is directly provided with multiple specifications to clamp the bolt or nut.

Yet another purpose of the present invention is to provide an innovative open-end adjustable spanner mechanism with benefits of diversified specification. To achieve the purpose, the handle of the present invention may be made in a single or double box accommodation trough adapted with the same number of ratchet and components depending on the form of design.

Yet another purpose of the present invention is to provide an innovative open-end adjustable spanner mechanism that easily completes turning of the work piece simply by holding the handle and using the thumb of the same hand to achieve fast and handy operation.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
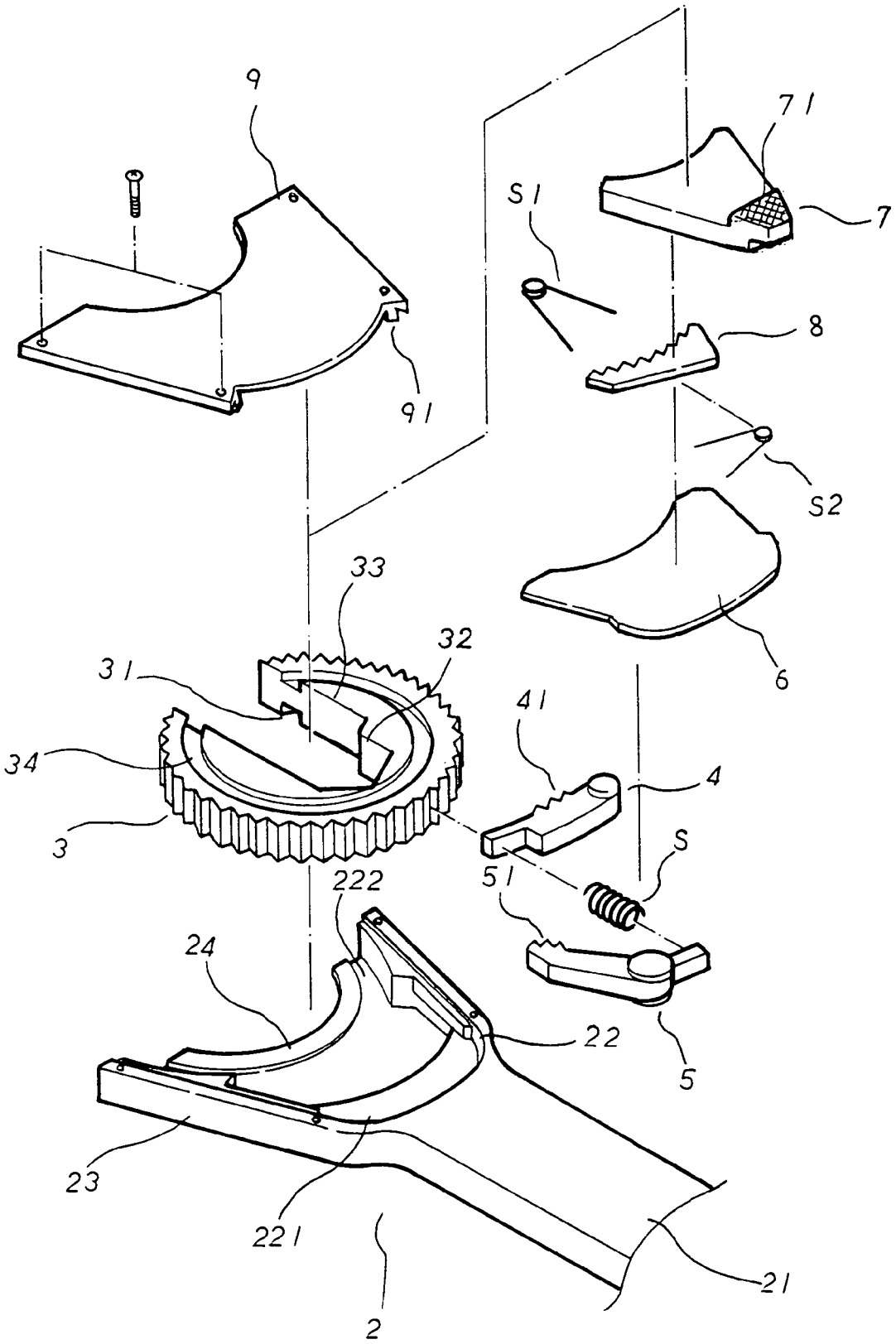
FIG. 1 is an exploded view of a preferred embodiment of the present invention.
Figure 2:
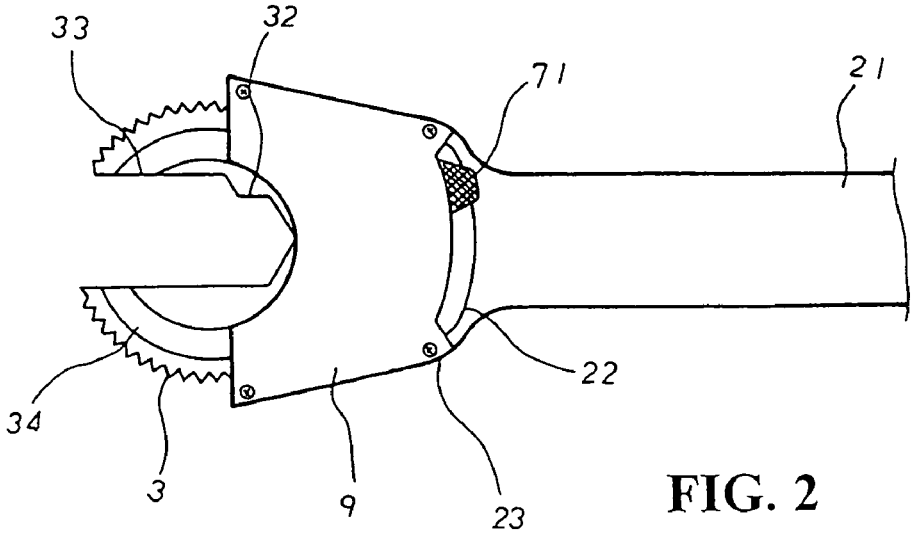
FIG. 2 is a schematic view showing the assembly of the preferred embodiment of the present invention.
Figure 3:
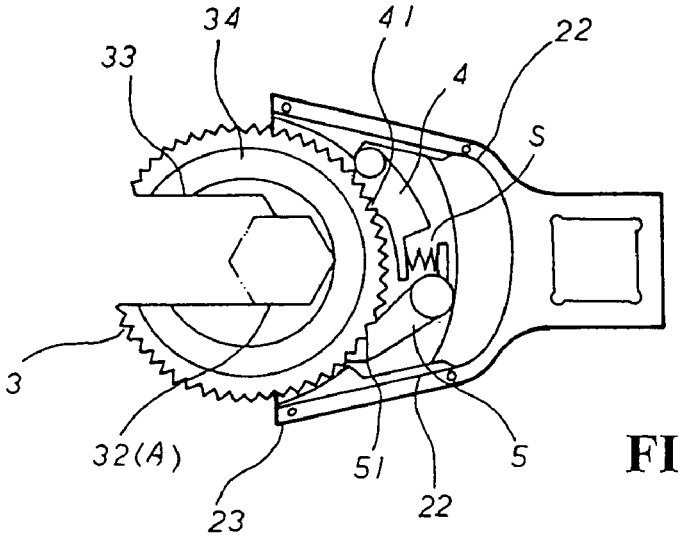
FIG. 3 is a view showing the arrangement of the lower deck of another preferred embodiment of the present invention.
Figure 4:
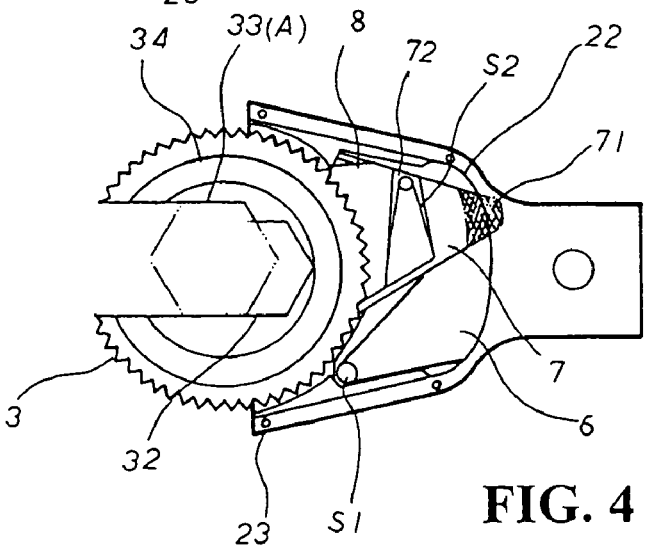
FIG. 4 is a view showing the arrangement of the lower deck of another preferred embodiment yet of the present invention.

Referring to the accompanying drawings, the present invention is essentially comprised of a spanner body 2, an open-end ratchet 3, a right latch 4, a return spring S, a left latch 5, a spacer 6, a control member 7, a serrated bit 8, a larger hairpin spring S1, a smaller hairpin spring S2, an upper lid 9 and associate screws or pins. The spanner body 2 includes a handle 21 and a head 23 provided at an end of the handle. The head 23 is formed with an accommodation trough 22 having an upper deck 221 and a lower deck 222. The outer edge of the head 23 is formed an arc raised or recessed channel 24 to merely lock into a recessed or raised slot 31 provided on the bottom of the ratchet 3. Two opening sections 32 and 33 at different width are formed in the open-end ratchet 3, and a recessed or raised channel 34 to lock to the upper lid 9 is disposed on the top of the open-end ratchet 3. The open-end ratchet 3 when assembled is arranged to engage hot serrated portions 41, 51 of the left and the right latches 5, 4 disposed in the lower deck 222 of the accommodation trough 22 in such way both of the left and the right latches 5, 4 are held against by the tension produced from the return spring S (as illustrated in FIG. 3 to be available for external connection to a socket wrench or any other tool). The spacer 6 is provided with its contour compromising that of the accommodation trough 22 to cover and compress the top of the left and the right latches 5, 4 to define segregation between the upper and the lower decks 221 and 222. A button 71 of the control member 7 provided on the upper deck 221 executes the control by traveling. A recess 72 on the bottom of the control member 7 contains the smaller hairpin spring S2 and the serrated bit 8. The smaller hairpin spring S2 forces the serrated bit 8 to engage with the open-end ratchet 3 and the larger hairpin S1 forces the control 7 to deflect to the right of the accommodation trough 22 (as illustrated in FIG. 4 to be available for external connection to any other tool with long handle or wrench of any hand tool in conjunction with a round box). The upper lid 9 is used to lock the ratchet 3 to the spanner body 2 to complete the assembly and positioning of the exposed button 71 of the control member 7 as illustrated in FIGS. 2 and 4. The arc raised or recessed slot of the upper lid 9 and its raised or recessed edge 91 must be locked to the recessed or raised slot 34 of the ratchet 3 and the contour of the accommodation trough 22.

Figure 5:
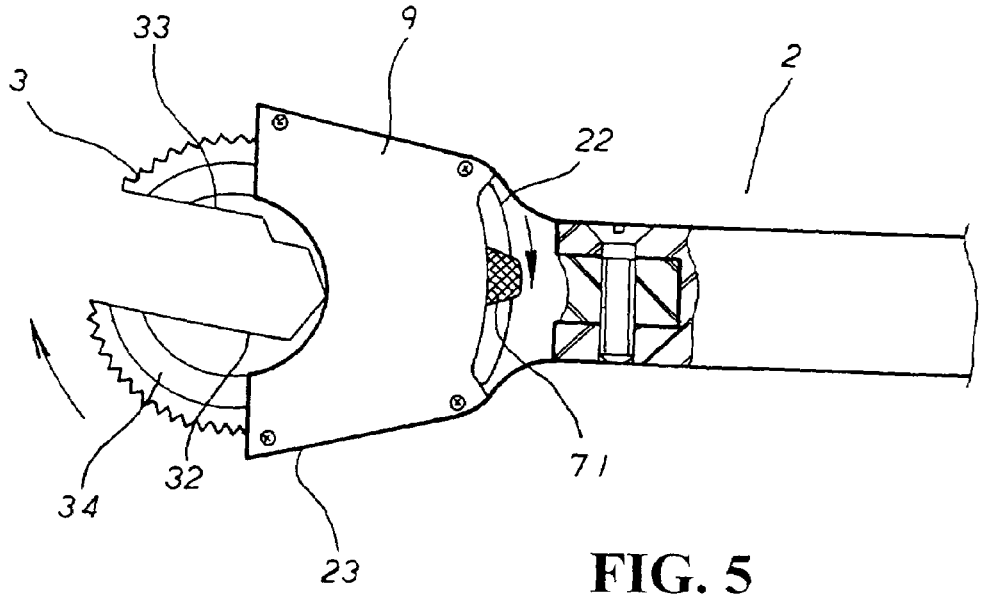
FIG. 5 is a schematic view showing that the present invention is in use with a handle screwed to an upper case.

In use, a user holds the spanner body 2 and operates either the smaller opening section 32 or the larger opening section 33 in the open-end ratchet 3. The force externally applied is transmitted from the spanner body 2 through the left and the right latches 5, 4 for both of the serrated portions 51, 41 of the left and the right latches 5, 4 to simultaneously or separately engage with the open-end ratchet 3 so as to drive the ratchet 3 to rotate and travel for tightening up a bolt or a nut A. When the spanner body 2 travels counterclockwise, bat of the serrated portions 51, 41 are cleared away from the ratchet 3 because both ends of each of the left and the right latches 5, 4 are plunged by the tension from the return spring S due to the absence of a constant support. Consequently, travel by bounced gearing occurs for the external force applied to transmit by either of both latches 5, 4 to execute travel by gearing. In the present invention, the control 7 is pushed to produce another type of force transmission mechanism to dive the open-end ratchet 3 to revolve and travel while displacing the locations of both opening sections 32, 33 as illustrated in FIG. 5. The present invention allows alignment of the open-end ratchet 3 with the bolt or the nut A before and after fixing the bolt or nut A thereby facilitating clamping of the bolt or nut A. The present invention also allows the force externally applied to the spanner body 2 to be transmitted via both of the left and the right latches 5, 4 to drive the open-end ratchet 3 to revolve, thus to tighten or loosen the bolt or nut A. The serrated section in the ratchet 3 of the present invention may be designed with any form including both of the serrated sections 32, 33 in different width, or in the same width, hexagon, octagon, dodecagon, or box-end, etc. to adapt to easy exchange depending on the shape of the work piece.

Figure 6:
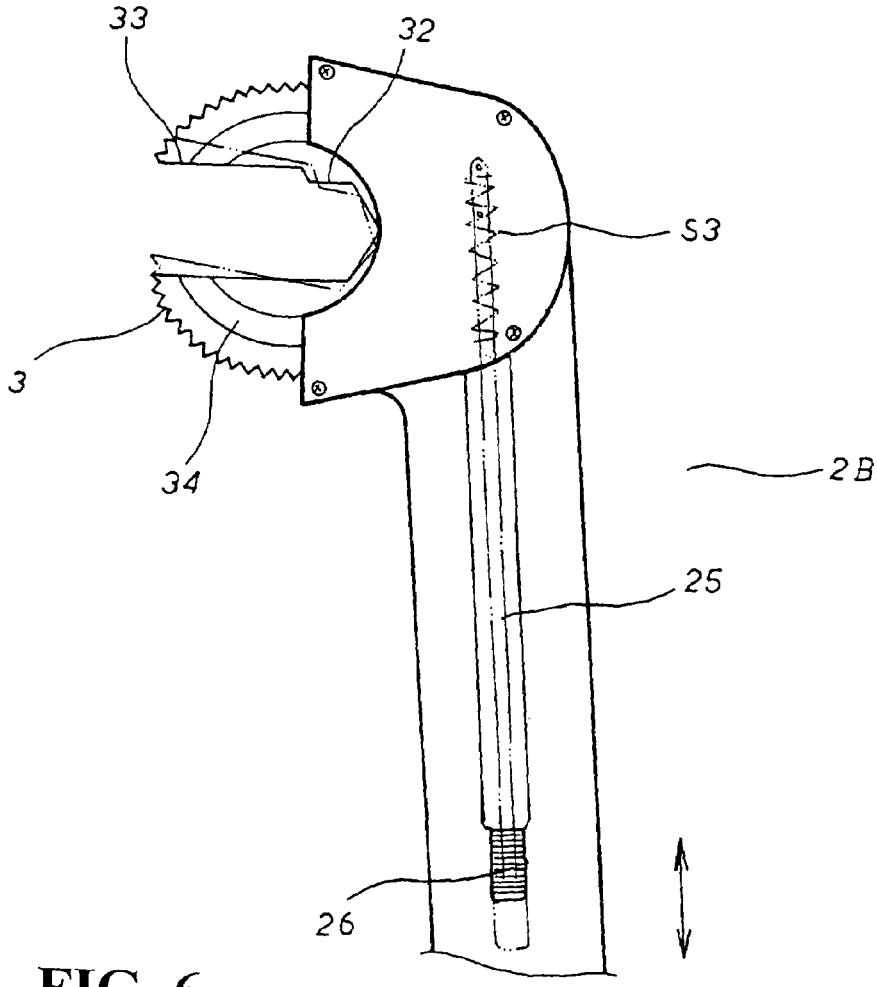
FIG. 6 is a schematic view showing another type of construction of the present invention.

Furthermore, as illustrated in FIG. 6 when the present invention is applied to an L shaped spanner body 2B with a long handle, a long member 25 adapted with a retaining spring S3 having one end of the long member 25 pivoted and secured to the control 7 and the other end secured to an adjustment slide 26 so to achieve the same purpose simply by pushing the adjustment slide 26.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An open end adjustable spanner comprising:

a spanner body having a handle and a head provided at one end of said handle, said head having an accommodation trough having an upper deck and a lower deck, an outer edge of said head being formed with an arc raised channel, said lower deck being positioned between said upper deck and said arc raised channel;

an open-end ratchet fitted in said head and having two opening sections at different widths, a bottom of said open-end ratchet having a recessed slot adapted to engage with said arc raised channel;

a first latch arranged in said lower deck and having a serrated portion;

a second latch arranged in said lower deck and having a serrated portion;

a return spring forcing said serrated portion of said first latch and second said serrated portion of said second latch to engage with said ratchet;

a spacer having a contour adapted to said accommodation trough to cover and keep said first and second latches in said upper deck;

a control member disposed on said spacer, said control member having a bottom formed with a recess in which are fitted a serrated bit and a first hairpin spring forcing said serrated bit to engage with said ratchet;

a second hairpin spring forcing said control member to one side of said accommodation trough; and an upper lid fastened on a top of said head.

* * * * *